US009975141B2

(12) United States Patent
Johnston et al.

(10) Patent No.: US 9,975,141 B2
(45) Date of Patent: May 22, 2018

(54) ROLLER CAP APPLICATOR AND ROLLER AXLE

(71) Applicant: Milspray, LLC, Lakewood, NJ (US)

(72) Inventors: Matthew L. Johnston, Bayville, NJ (US); Christian E. Steinmetz, Mickleton, NJ (US)

(73) Assignee: MILSPRAY LLC, Lakewood, NJ (US)

( * ) Notice: Subject to any disclaimer, the term of this patent is extended or adjusted under 35 U.S.C. 154(b) by 0 days. days.

(21) Appl. No.: 14/862,801

(22) Filed: Sep. 23, 2015

(65) Prior Publication Data

US 2017/0080451 A1 Mar. 23, 2017

(51) Int. Cl.

| | |
|---|---|
| ***B43M 11/02*** | (2006.01) |
| ***B05C 17/035*** | (2006.01) |
| ***B05C 17/02*** | (2006.01) |
| ***B05C 17/03*** | (2006.01) |

(52) U.S. Cl.

CPC ..... *B05C 17/0357* (2013.01); *B05C 17/0217* (2013.01); *B05C 17/0222* (2013.01); *B05C 17/035* (2013.01); *B05C 17/0325* (2013.01)

(58) Field of Classification Search

CPC ..... B05C 1/00; B05C 17/00; B05C 17/0235; B05C 17/035; B05C 17/0325; B05C 17/0357; A46B 11/001; A46B 2200/20; A46B 11/0013

USPC ..... 401/219–220, 197

See application file for complete search history.

(56) References Cited

U.S. PATENT DOCUMENTS 4,063,325 A * 12/1977 Lizak ..... B05C 17/0222 15/230.11
4,150,904 A * 4/1979 Stewart ..... B05C 17/0205 401/186
4,167,349 A * 9/1979 Testa ..... B05C 17/035 222/340
4,765,353 A * 8/1988 Rhoades ..... B05C 17/022 134/138
5,095,575 A * 3/1992 Jarecki ..... B05C 17/0222 134/182
5,614,021 A * 3/1997 Catlin ..... B05C 17/035 118/258
6,161,978 A * 12/2000 Dovellos ..... A46B 11/0041 401/271
7,101,106 B1 * 9/2006 Wiley ..... A45D 34/041 401/205
7,338,227 B2 * 3/2008 Bullivant ..... A46B 11/0013 401/208
8,434,192 B2 * 5/2013 Dondurur ..... B05C 17/0222 15/230.11
8,632,271 B2 * 1/2014 Walcot ..... B05B 9/0403 401/125

(Continued)

*Primary Examiner* — Jennifer C Chiang
(74) *Attorney, Agent, or Firm* — Freeman Intellectual Property Law LLC; Mark E. Freeman

(57) ABSTRACT

The invention is a roller liquid compound applicator configured to attach to the threaded neck of a liquid supply container for the purpose of applying a coating of a liquid compound to a target surface, and includes: a U-shaped roller support frame including a substantially cylindrical dispenser coupling cap and a drip guard attached to the dispenser coupling cap, the dispenser coupling cap having a threaded cavity configured for mating with the threaded neck of the liquid supply container; and a liquid compound roller sleeve secured to the roller support frame.

14 Claims, 6 Drawing Sheets

(56) References Cited

U.S. PATENT DOCUMENTS

| | | | | |
|---|---|---|---|---|
| 8,757,914 | B1 * | 6/2014 | Megaro | A45D 34/041 401/218 |
| 8,832,896 | B2 * | 9/2014 | Sandahl | B05C 17/0222 15/114 |
| 8,845,222 | B2 * | 9/2014 | Frank | B05C 17/0333 401/150 |
| 2001/0049852 | A1 * | 12/2001 | Burns | B05C 17/02 15/144.1 |
| 2005/0169693 | A1 * | 8/2005 | Serio | B43M 11/06 401/219 |
| 2006/0239760 | A1 * | 10/2006 | Chen | B05C 17/00513 401/219 |
| 2007/0020035 | A1 * | 1/2007 | Bruggeman | A46B 11/0062 401/219 |
| 2007/0031178 | A1 * | 2/2007 | Massimi | B44D 3/00 401/219 |
| 2007/0048068 | A1 * | 3/2007 | Bullivant | A46B 11/0013 401/220 |
| 2010/0209175 | A1 * | 8/2010 | Walcot | B05B 9/0403 401/197 |
| 2014/0153996 | A1 * | 6/2014 | Ammerman | A45D 34/041 401/219 |

* cited by examiner

Section A-A

Section B-B

Section C-C

Section D-D

Section E-E

ROLLER CAP APPLICATOR AND ROLLER AXLE

FIELD OF THE INVENTION

The present invention relates to an applicator device for spreading a film of a liquid compound onto a target substrate from a liquid supply container removably attached to the applicator device.

BACKGROUND OF THE INVENTION

Conventional liquid application techniques, such as used in painting, employ devices commonly referred to as "paint rollers." Such techniques require the frequent saturation of a cylindrical paint roller pad with liquid paint from a separate paint reservoir, basin, or paint tray containing a supply of the paint. For "touch-up" purposes, a smaller version of the traditional paint roller is sometimes used. In such applications, the roller mechanism and the paint tray or reservoir is significantly smaller in dimension than the standard or typical paint tray or reservoir. Otherwise, the operation of these smaller versions is very similar to the operation of the standard or typical paint rollers.

Many common paint touch-up applicators include a bottle or reservoir for holding liquid paint and typically have a threaded neck portion or other locking mechanism that allows a roller applicator to be attached. A single and centrally located fluid port extends between the bottle opening and a surface adjacent to a roller pad. In such applicators it is likely that the fluid port may be off-center with respect to the roller axis alignment with the bottle or reservoir.

Common application processes in which one skilled in the trade may paint a vertical wall, such devices require specific orientation for which the device needs to be aligned in vertical position, with respect to vertical alignment, in which the fluid port is in the upper position to the central roller axis origin. Further, should the orientation be inverted, and the fluid port is in the lower position to the central roller axis, with respect to vertical alignment, the paint will often drip from the roller and fluid port and on to the floor.

Another deficiency in common touch-up roller devices is the lack of even paint distribution across the surface of the roller pad. Embodiments that contain a fluid port that enables paint to be transferred from a bottle, through a roller housing, and onto a roller surface, typically contain a single fluid port which delivers paint to a central location on the roller pad surface. The paint is most likely concentrated centrally to the pad surface and inhibits paint saturation across the width of roller pad. An operator of such device cannot apply paint upon a surface for which the deposition of paint upon that surface is not uniform because the application device fails to deliver paint uniformly upon the roller surface. Such devices result in the delivery of paint from the single port onto the central circumference of the roller surface, leaving large portions on either side of the central circumference of the roller surface deficient in paint saturation.

Yet another shortcoming found in conventional touch-up roller devices is the lack of versatility. The utility of such device requires the user to disassemble the roller device to gain access to the paint reservoir. In such devices, the roller applicator assembly and the reservoir are of a specific size and dimension as to allow proper mating or assembly.

For example, many craft stores commonly sell small pre-filled bottles of paint, and bottles of glue, and bottles of other liquids that may be applied to a surface. As such, a consumer of these products must also purchase a hand-held application device whereas such device may be a paintbrush, or a paint roller, or a painting sponge, or paint knife, or other paint application device. Within this example, the application device cannot be attached to the pre-filled paint bottle. The small pre-filled bottles of paint or other liquid have a narrow diameter bottle opening which prevent the consumer from dipping a paintbrush directly into the bottle, thus requires the acquisition of a reservoir to pour the paint or other liquid into and also requires frequent re-saturation, or dipping, of the application device within the now liquid-containing reservoir.

One popular application device, the SHUR-LINE Touch Up Painter model #1859464, is supplied with a reservoir bottle that is properly mated to, and affixes directly to the SHUR-LINE Touch Up Painter roller housing. As such, the affixing mechanism, or threads, of the roller housing are not universally mated to other readily available pre-filled bottles of paint, or bottles of glue, or bottles of other liquids that may be applied to a surface, such as craft paints, thus cannot be directly affixed to such pre-filled bottles of paint.

What is needed is a small self-contained paint transfer device that: (i) does not require a separate paint tray for saturation or re-saturation of paint or other liquid compound onto the roller surface; (ii) mitigates the dripping of paint from the device; (iii) does not require specific device orientation during the process of use; (iv) supplies sufficient distribution of liquid compound or paint to the surface of the paint roller pad to enable desired consistency of liquid compound or paint deposition upon a substrate; (v) contains an internal reservoir within the body of the roller housing to aid in the liquid reclaim from the roller due to roller over-saturation as well as supplying a distribution of paint to the roller surface, and (vi) such device that contains a common screw-on thread design as to allow attachment to prefilled paint bottles supplied and distributed through common retail establishments, such as Michael's Stores, AC Moore Stores, Walmart, and Jo Ann stores, and to enable the user to fill bottles with liquid paint.

As such, there is continuous and direct application from the manufactures' pre-filled liquid compound bottle onto a transfer surface and subsequently continuous and direct transference onto a desired application substrate, thus eliminating otherwise required steps of transferring such liquid compound into a reservoir, or a cup, or a tray, and further dipping or saturating an application device into such liquid filled reservoir, or cup, or tray, and further subsequent transference of liquid compound to a desired substrate by means of the application device, and further multiple repetition of such steps for continued application to the target substrate.

BRIEF SUMMARY OF THE INVENTION

In an exemplary embodiment of the present invention, a roller liquid compound applicator configured to attach to the threaded neck of a liquid supply container for applying a coating of a liquid compound to a target surface, comprises: a U-shaped roller support frame including a substantially cylindrical dispenser coupling cap and a drip guard attached to the dispenser coupling cap, the dispenser coupling cap having a threaded cavity configured for mating with the threaded neck of the liquid supply container; and a liquid compound roller sleeve secured to the roller support frame.

In another exemplary embodiment of the present invention, a roller liquid compound applicator suitable for conveying a predetermined amount of a liquid compound from a liquid supply container to a target surface, said roller liquid compound applicator comprising: a U-shaped roller support frame including a substantially cylindrical dispenser coupling cap, said dispenser coupling cap having a threaded cavity configured to mate with the threaded neck of the liquid supply container; a drip guard with a concave surface disposed on said dispenser coupling cap; a liquid compound roller sleeve secured to said roller support frame, said liquid compound roller sleeve having a convex surface such that said liquid compound roller sleeve is partially enclosed by said drip guard concave surface; a liquid compound conveyance path extending from the liquid supply container to said liquid compound roller sleeve, said liquid compound conveyance path including, a liquid reservoir disposed at a base end of said dispenser coupling cap for holding a predetermined quantity of the liquid compound; a liquid conduit disposed between said threaded cavity and said liquid reservoir for conveying said predetermined quantity of the liquid compound from the liquid supply container to said liquid reservoir; two liquid compound flow ports extending from said liquid reservoir to said concave surface; and two liquid compound flow ports extending from said liquid reservoir to said concave surface; and a liquid compound distribution channel disposed in said concave surface, said liquid compound distribution channel extending between said liquid compound flow ports such that said liquid compound distribution channel functions to distribute the liquid compound received from said liquid compound flow ports across said convex surface of said roller liquid compound applicator.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying figures, in which.

DETAILED DESCRIPTION OF THE INVENTION

Figure 1:
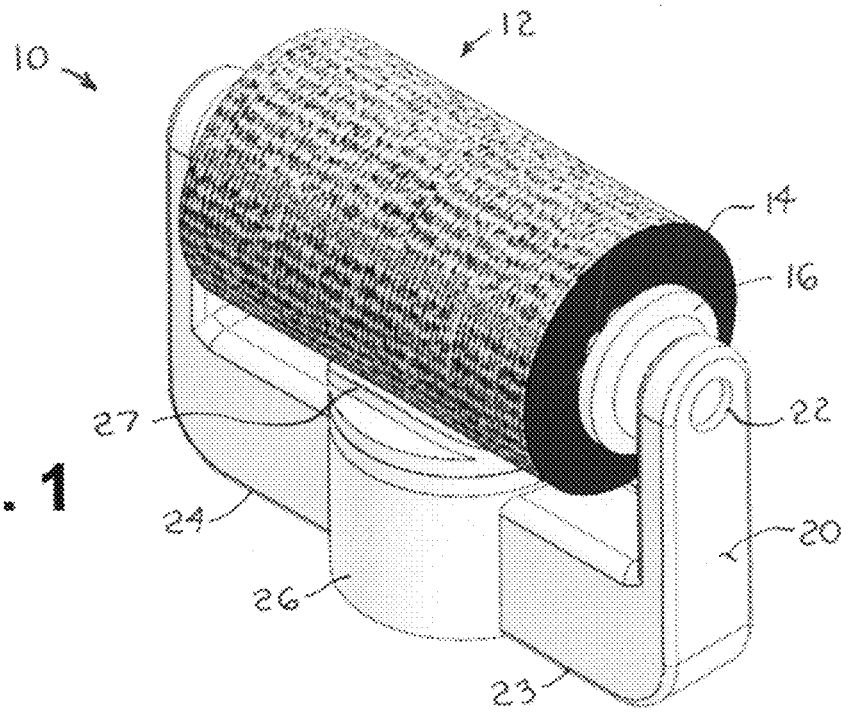
FIG. 1 is a diagrammatical perspective view of a roller liquid compound applicator comprising a liquid transfer roller assembly with a liquid compound roller sleeve removably secured in a roller support frame, in accordance with the present invention.

The following detailed description is of the best currently contemplated modes of carrying out the invention. The description is not to be taken in a limiting sense, but is made merely for the purpose of illustrating the general principles of the invention. The present invention relates to an applicator device for applying a layer of a liquid compound onto a target substrate without requiring a separate tray or an open container for supplying the liquid compound to the applicator device.

The present invention is a roller liquid compound applicator that can be affixed onto a liquid supply container having a threaded neck, preferably a flexible walled plastic bottle. The liquid compound is transferred to a rotatable cylindrical form that has been affixed to a free-moving axle that is further affixed to a dispenser coupling cap, or housing, that supports the axle. The liquid compound is further transferred to a surface or substrate by direct contact of the cylindrical form to the surface or substrate. Greater areas of paint coverage upon such surface are typically achieved by means of traversing the surface with the liquid compound paint-saturated rotatable surface, commonly referred to as "rolling" the paint upon such surface.

The roller liquid compound applicator includes at least two fluid port openings, and at least one distribution channel forming a shallow cavity in the paint roller fixture joining each fluid port opening. The one or more distribution channels intersect the fluid port openings to physically contain liquid compound pooling between the fluid port openings. A liquid compound reservoir is contained within the dispenser coupling cap of the roller assembly; and includes a drip guard for the determent of liquid compound paint drippage from the roller fixture. The present invention also includes a roller axle for use with the paint roller fixture.

The roller liquid compound applicator may be attached to a threaded bottle of compatible thread size which has been previously filled with paint or other liquid. Such paint supply bottles may be manufactured or distributed by, for example: (i) Fabrique' Par Fabricado Por under the commercial name ILOVETOCREATE located at 5673 Ease Shields Avenue; Fresno, Calif. 93727, (ii) Michaels Stores, Inc. located at 8000 Bent Branch Drive; Irving, Tex. 75063, and (iii) Plaid Enterprises, Inc. with the mailing address of PO Box 7600; Norcross, Ga. 30091. In such commercially available products, the disclosed roller liquid compound applicator is screwed onto, or otherwise securely affixed onto, the neck of the bottle of paint.

In an exemplary embodiment, the roller liquid compound applicator may contain systematic beveled protrusions or angular segments about the circumference of the inner wall of the threaded portion, or dispenser coupling cap, that create primary and secondary seals, respectively, about the outer edge of the upper rim of the neck of the bottle, and about the inner edge of the upper rim of the neck of the bottle respectively. The angular beveled protrusions or angular segments located in the base of the dispenser coupling cap function to create liquid-tight seals both about the outside edge of the affixed bottle neck and about the inside edge of the affixed bottle neck.

An additional aspect of the present invention is the transfer, or transmission, of liquid compound from a bottle that contains the liquid compound, via a liquid compound conveyance path. In an exemplary embodiment, the liquid compound conveyance path comprises: (i) a liquid conduit contained within the base of a dispenser coupling cap, (ii) a liquid reservoir in fluid communication with the liquid conduit, (iii) at least two liquid compound flow ports in fluid communication with the liquid reservoir, and (iv) a liquid compound distribution channel in fluid communication with the liquid compound flow ports and with the roller liquid compound applicator. The reservoir accumulates liquid compound paint that was transferred from the bottle, and further allows the liquid compound to enter into the fluid ports that extend from the liquid reservoir and to a surface adjacent the roller pad surface. This liquid compound distribution channel aids in the even distribution of paint across the roller liquid compound applicator. In the event that a port becomes clogged, and does not function to bring the liquid compound to the concave surface, the distribution channel will allow excess paint to travel to the clogged side of the roller promoting an even dispersal of paint to the roller form.

The present invention contains anti-drip guards beginning near the exit ports and continuing upward and outward as to come within close proximity to, but not interfering with the roller form. The purpose of the anti-drip guards is to prevent the liquid compound from dripping from the ports, by ensuring that the ports directly contact the absorbing material of the roller form. The close proximity of the anti-drip guards also ensures that large quantities of excess paint do not accumulate on a portion of the roller form at a single time by limiting the volume of space the excess paint may occupy.

There is shown in FIG. 1 a perspective view of a roller liquid compound applicator 10 comprising a liquid transfer roller assembly 12 removably secured in a roller support frame 20. The roller support frame 20 is generally U-shaped comprising opposed L-shaped support frame arms 23, 24, both frame arms 23, 24 connected to a dispenser coupling cap 26. A drip guard 27 on the dispenser coupling cap 26 has a concave surface 33 (shown in FIG. 2) substantially matching, or conforming to, the convex cylindrical curvature of a liquid compound roller sleeve 14, as explained in greater detail below.

The liquid compound roller sleeve 14 is installed in the liquid transfer roller assembly 12 by sliding onto a roller axle 16. The liquid compound roller sleeve 14 may comprise a sponge or a similar type of porous, absorbent, or wicking material to aid in retaining liquid compound on the roller assembly 12 for subsequent transfer to a target surface. The roller axle 16 has opposed ends configured to fit into respective axle retaining holes 22 in the L-shaped support frame arms 23, 24. The roller support frame 20 may be fabricated from a rigid but flexible material, such as a plastic, e.g., polypropylene, so as to allow installation and removal of the liquid transfer roller assembly 12 by flexing apart the support frame arms 23, 24 to allow removal from the axle retaining holes 22.

Figure 2:
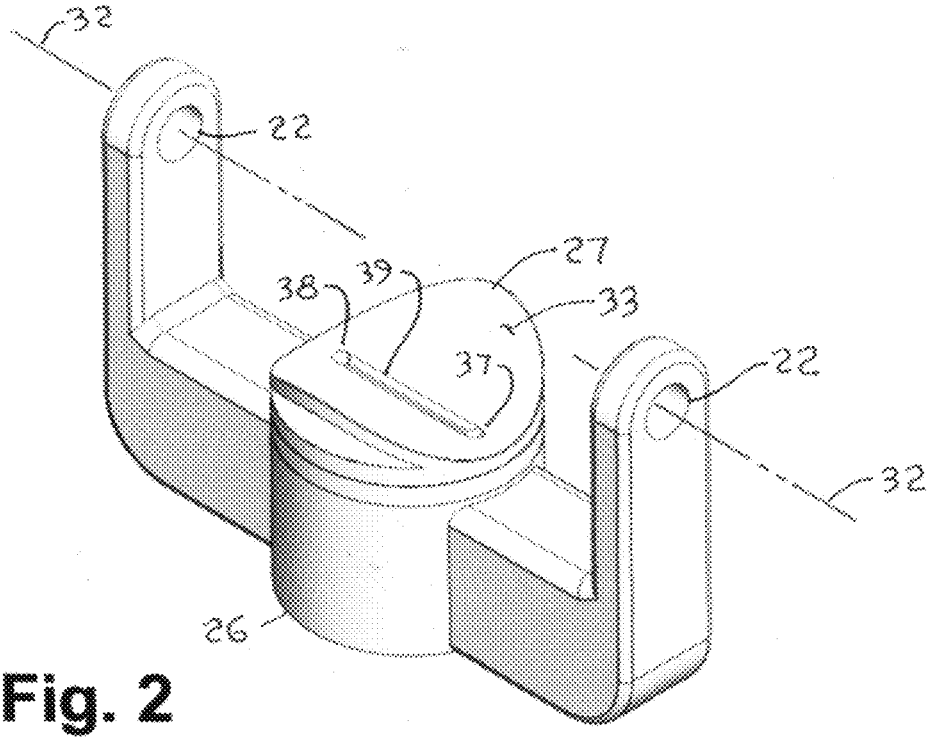
FIG. 2 is an isometric view of the roller support frame of FIG. 1 with support frame arms showing a liquid compound distribution channel and liquid compound flow ports.

FIG. 2 shows an isometric perspective view of the roller support frame 20 to illustrate that, when the liquid transfer roller assembly 12 is mounted into the roller support frame 20, the liquid transfer roller assembly 12 is free to rotate about a longitudinal roller axis 32. The support frame arms 23, 24 are preferably formed with, or bonded to, the dispenser coupling cap 26 such that the longitudinal roller axis 32 passes through the centers of the respective axle retaining holes 22. The circular cylindrical shape of the concave upper guard surface 33 of the drip guard 27 comprises drip guard ears 28, 29, best seen in FIG. 7. A liquid compound distribution channel 39 is recessed within the upper guard surface 33, in FIG. 2. A first liquid compound flow port 37 and a second liquid compound flow port 38 open into the liquid compound distribution channel 39. It should be understood that two or more liquid compound distribution channels, and additional liquid compound flow ports, may be provided in the upper guard surface 33, but only one liquid compound distribution channel and only two liquid compound flow ports are shown for clarity of illustration.

Figure 3:
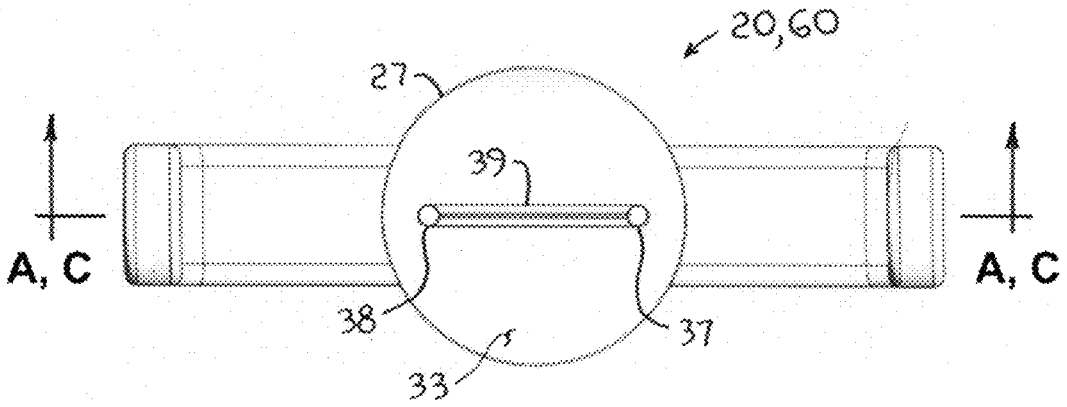
FIG. 3 is a diagrammatical top view of the roller support frame of FIG. 2 showing the liquid compound distribution channel and the liquid compound flow ports.
Figure 9:
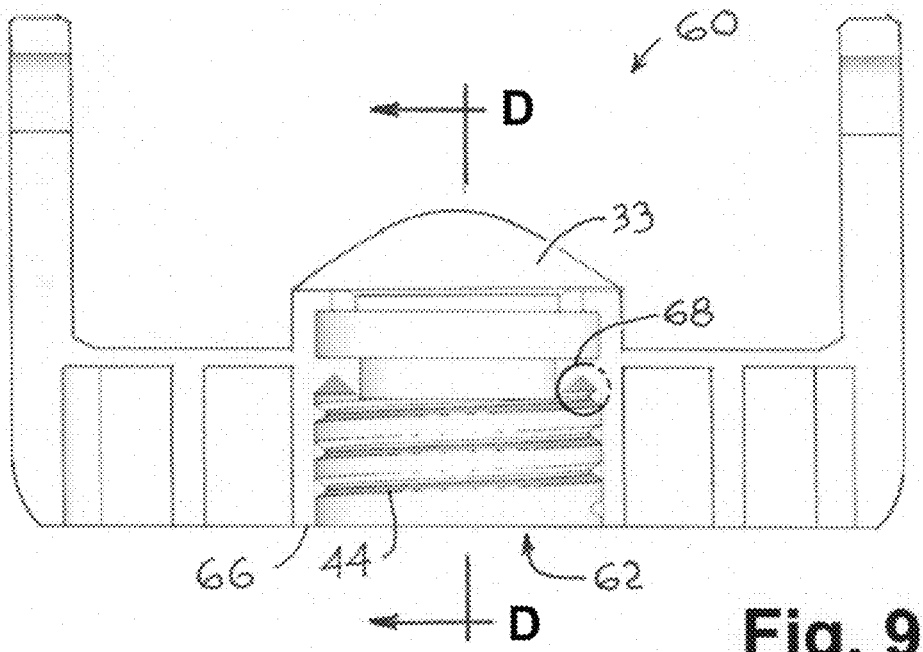
FIG. 9 is a diagrammatical cross-sectional front view of an alternative embodiment of the roller support frame of FIG. 2 showing the liquid compound reservoir, the liquid conduit, and a modified threaded cavity.

FIG. 3 is a top diagrammatical view of the roller support frame 20, and a support frame 60 shown in FIG. 9, showing the two liquid compound flow ports 37, 38 comprising through holes originating in the upper guard surface 33 of the drip guard 27. It should be understood that one or more additional liquid compound flow ports may be provided in the drip guard 27 as desired. The liquid compound distribution channel 39 functions-to aid in even dispersal of liquid compound onto the liquid compound roller sleeve 14, when used in accordance with the present invention. The liquid compound distribution channel 39 may include rounded edges and corners to mitigate the build-up of dried liquid compound in the liquid compound distribution channel 39, and to promote the fluid motion of liquid compound across the length of the liquid compound distribution channel 39.

Figure 4:
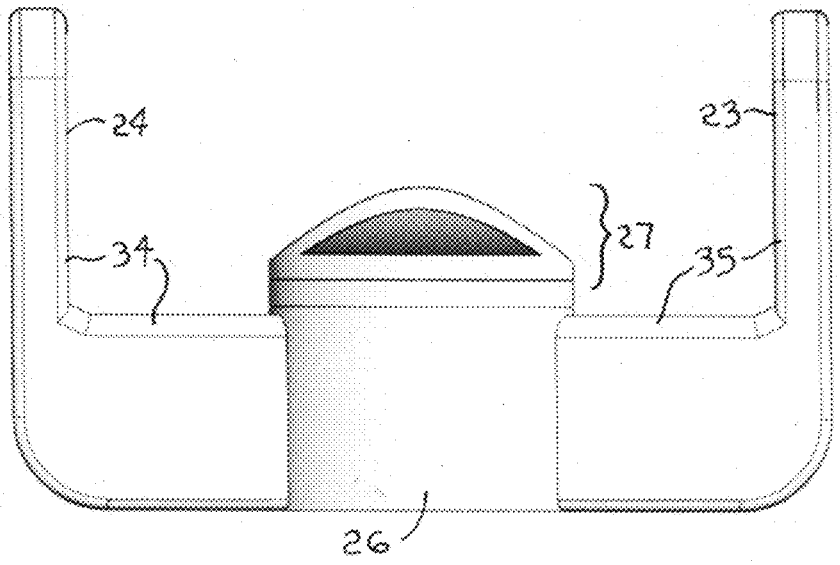
FIG. 4 is a diagrammatical front view of the roller support frame of FIG. 2 showing beveled edges on the support frame arms.

FIG. 4 is a diagrammatical front view of the roller support frames 20 and 60. The support frame arms 23, 24 are secured to opposite sides of the dispenser coupling cap 26 to form the U-shape described above. In an exemplary embodiment, the inside surfaces of the respective support frames 23, 24 are spaced at a distance sufficiently wide to accommodate a liquid compound roller sleeve approximately 5.4 cm in length. The respective edges 34, 35 of the support frame arms 23, 24 may be beveled to provide additional desired rigidity to the roller support frame 20. External corners of the drip guard ears 28, 29 may be rounded for aesthetics and for user-friendly comfort by avoiding the presence of sharp edges on which minor injury may occur.

Figure 5:
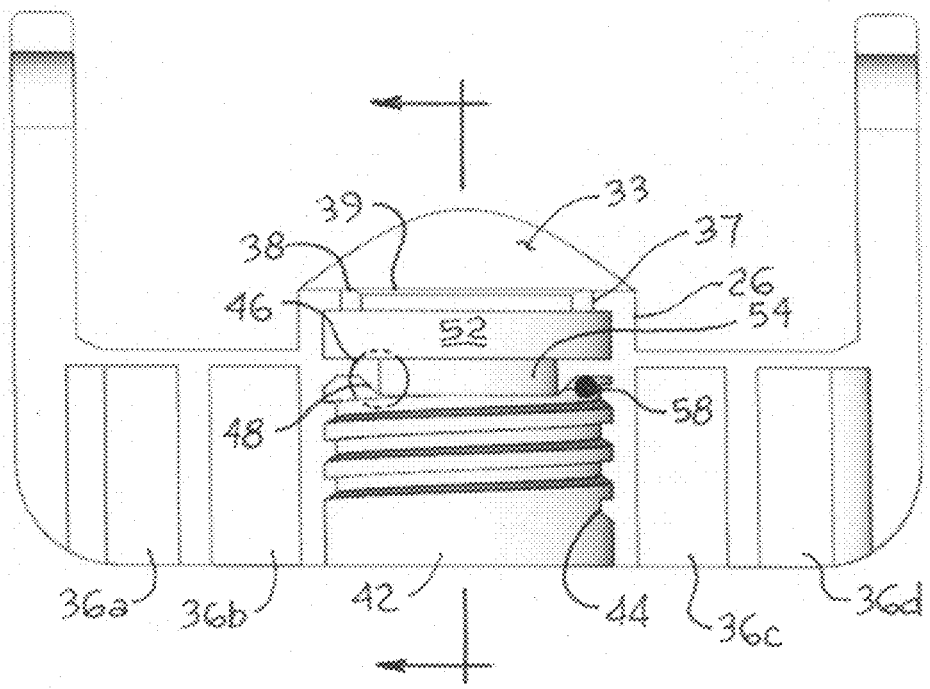
FIG. 5 is a diagrammatical cross-sectional front view of the roller support frame of FIG. 2 showing a liquid compound reservoir, a liquid conduit, and a threaded cavity.

FIG. 5 is a front cross-sectional view of the roller support frame 20, indicated as Section A-A in FIG. 3. In an exemplary embodiment, the dispenser coupling cap 26 of the roller support frame 20 may comprise a threaded cavity 42 with internal threads 44 that provide means to enable attachment to a user-supplied container of paint or other liquid having a neck with compatible external threads. It should be understood that the internal threads 44 are optional, and that a smaller paint container, having a smooth neck, can be press-fitted into a non-threaded cavity (not shown) if desired. In another alternative embodiment, a step-up adapter (not shown) may be threaded into in the dispenser coupling cap 26 to provide a mating connection for a conventional consumer water hose (not shown) to flush out the roller support frame 20 using a household water source.

It can be seen that liquid compound flow ports 37, 38 extend from the upper guard surface 33 to a liquid reservoir 52. A liquid conduit 54 provides a liquid compound flow path from the threaded cavity 42 to the liquid reservoir 52 such that liquid compound in any attached liquid supply container (not shown) can be conveyed to the liquid compound distribution channel 39 via the reservoir 52. A conical wall 46 encloses the liquid conduit 54 to provide a seal for mitigating leakage of liquid compound from the threaded cavity 42.

The conical wall 46 is sized and configured to fit into the opening of an attached liquid supply container such that: (i) at least a portion of the conical wall 46 projects into the opening of the attached liquid supply container, and (ii) an oblique surface 48 of the conical wall 46 bears against the inside rim of the container neck opening. In an exemplary embodiment, an O-ring 58 (shown only partially for clarity of illustration) may further be included to improve sealing between the liquid supply container and the roller support frame 20. When the dispenser coupling cap 26 is screwed onto the threaded neck of the liquid supply container, the end of the container neck bears down against the O-ring 58. The roller support frame 20 may also include a plurality of recesses 36*a*, 36*b*, 36*c*, and 36*d* formed in the roller support frame 20 to reduce the amount of material needed for fabrication of the roller support frame 20.

Figure 6:
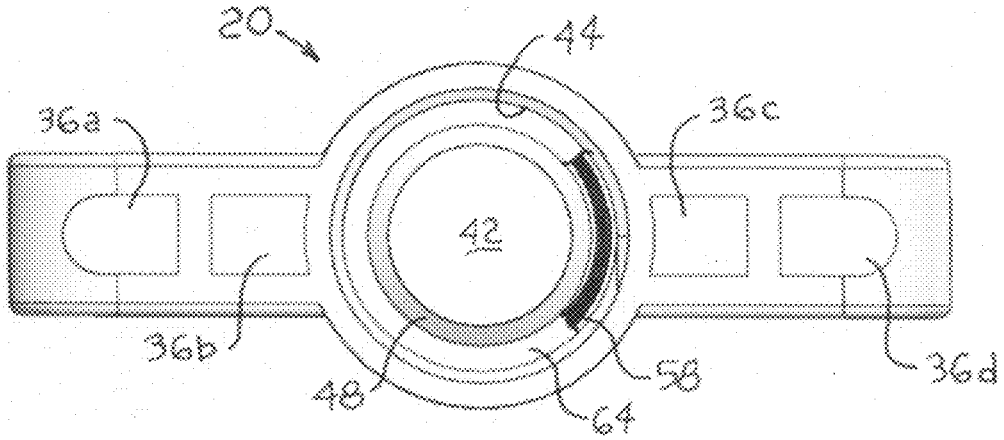
FIG. 6 is a diagrammatical bottom view of the roller support frame of FIG. 2 showing a sealing bevel in the threaded cavity of FIG. 5.

FIG. 6 is a bottom diagrammatical view of the roller support frame 20 showing the threaded cavity 42 with the internal threads 44 adapted to mate with a threaded neck of the liquid supply container (not shown). The openings of the recesses 36*a*, 36*b*, 36*c*, and 36*d* are sized so as to reduce component material while still providing structural integrity to the roller support frame 20. The conical wall 46 is more clearly shown in the base of the threaded cavity 42 as comprising the oblique surface 48 which functions to bear against the inside circular edge of the rim of the neck of the attached liquid supply container. When used, the O-ring 58 (shown only partially for clarity of illustration) may be located on a flat annular base 64 located at the far end of the threaded cavity 42, such that the end of the container neck forces the O-ring 58 against the flat annular base 64.

Figure 7:
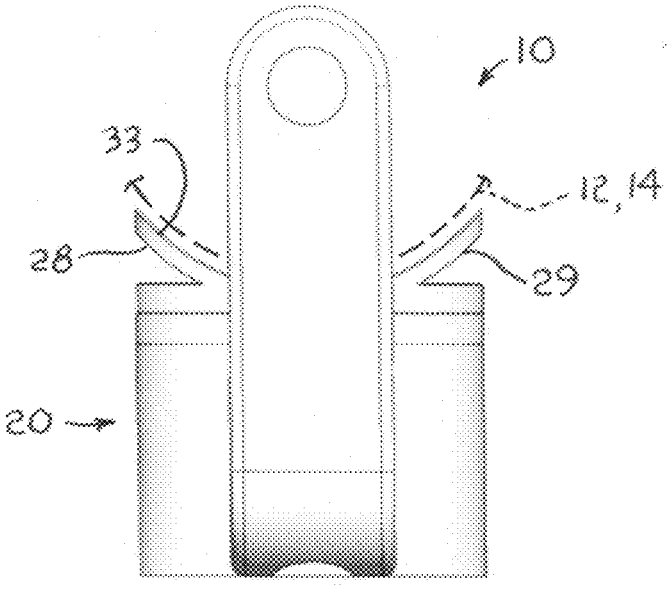
FIG. 7 is a diagrammatical side view of the roller support frame of FIG. 2 supporting the liquid transfer roller assembly of FIG. 1.

FIG. 7 is a side diagrammatical view of the roller liquid compound applicator 10 showing the positioning of the convex upper guard surface 33 adjacent the outer surface of the installed liquid compound roller sleeve 14 in the roller assembly 12, shown in phantom. Accordingly, the drip guard ears 28, 29 are positioned to be in close proximity to, if not in contact with, the liquid compound roller sleeve 14, to prevent excessive liquid spread onto the liquid compound roller sleeve 14, as described above. In an exemplary embodiment, the roller support frame 20 may have an overall height of approximately 4.6 cm and an overall width of approximately 2.8 cm.

Figure 8:
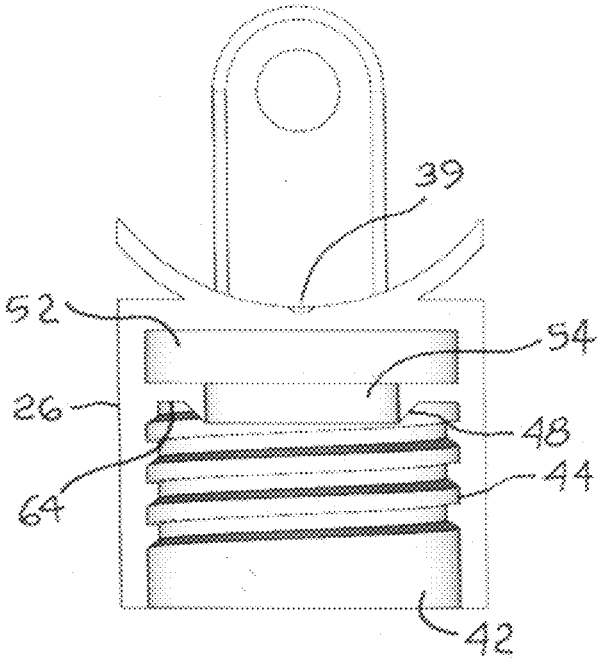
FIG. 8 is a diagrammatical cross-sectional side view of the roller support frame of FIG. 2.

FIG. 8, identified as Section B-B in FIG. 5, is a side sectional view of the threaded cavity 42 in the dispenser coupling cap 26. FIG. 8 shows the relative locations of the liquid compound distribution channel 39, the liquid compound reservoir 52, the liquid conduit 54, the conical wall 46, the oblique convex conical surface 48, the flat annular base 64, and the internal threads 44. It can be appreciated that the flat annular base 64 serves as a bearing surface for the O-ring 58 (not shown).

During operation of the roller liquid compound applicator 10, liquid compound flows from the liquid supply container (not shown), when screwed into the threaded cavity 42, into the liquid conduit 54, into the liquid reservoir 52, through the liquid compound flow ports 37, 38 (not shown for clarity of illustration), and fills the liquid compound distribution channel 39. The liquid compound in the liquid compound distribution channel 39 is then picked up or absorbed by the liquid compound roller sleeve 14, as best seen in FIG. 7, by means of gravity feed or by a user squeezing the liquid supply container, as the liquid transfer roller assembly 12 is rotated.

Figure 10:
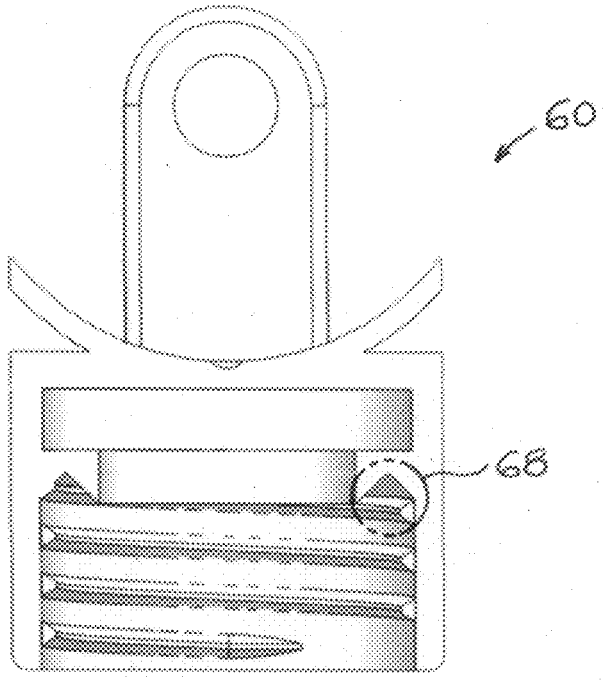
FIG. 10 is a diagrammatical cross-sectional side view of the roller support frame of FIG. 9.

FIG. 9, identified as Section C-C in FIG. 3, is a front cross-sectional view of a roller support frame 60, which is similar to the front cross-sectional view of the roller support frame 20 in FIG. 5. In this alternative roller support frame embodiment, the roller support frame 60 comprises a dispenser coupling cap 66 having a threaded cavity 62 with the internal threads 44 terminating in a grooved configuration 68. The grooved configuration 68 feature serves to bear against both the outside edge of the rim of an attached container (not shown) and the inside edge of the container rim. The grooved configuration 68 is shown with greater clarity in FIG. 10, identified as Section D-D in FIG. 9.

Figure 11:
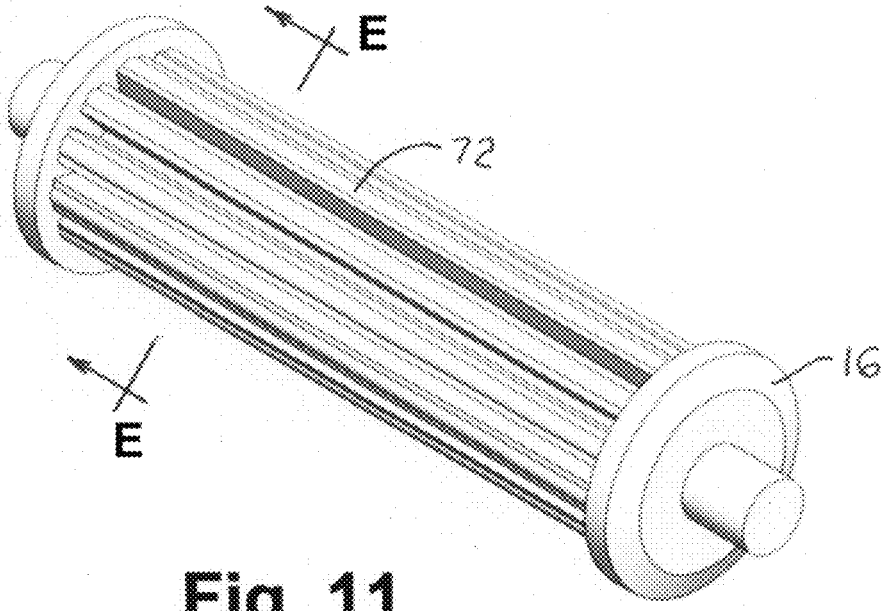
FIG. 11 is an isometric view of a roller axle used with a liquid compound roller sleeve to form the liquid transfer roller assembly of FIG. 7.
Figure 12:
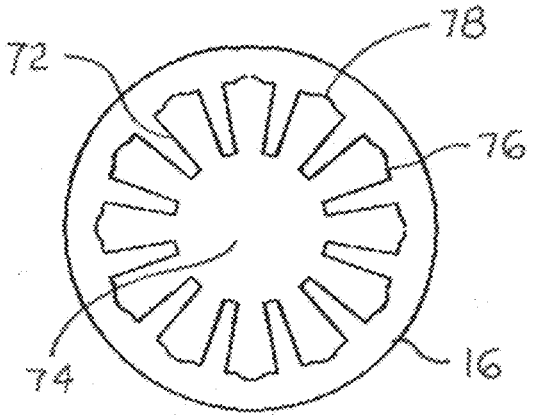
FIG. 12 is a cross-sectional side view of the roller axle of FIG. 9 showing longitudinal serrations used to retain the liquid compound roller sleeve of FIG. 1.

FIG. 11 is an isometric perspective view of the roller axle 16 with the liquid compound roller sleeve 14 removed. A plurality of longitudinal serrations 72 may be provided on a central supporting core 74, shown in FIG. 12, to prevent lateral slippage of the liquid compound roller sleeve 14 on the roller axle 16. FIG. 12, identified as Section E-E in FIG. 11, is a cross sectional side view of the roller axle 16 showing the cross-sectional configuration of the longitudinal serrations 72. A plurality of the longitudinal serrations 72 are spaced at radially equidistant intervals of one another spanning from a central supporting core 74. The outer edge 76 of each longitudinal serration 72 is complimented by a rounded ridge 78 to assist in a smooth roll out while ensuring that the liquid compound roller sleeve 14 (not shown) is securely fastened to the roller axle 16.

It is to be understood that the description herein is only exemplary of the invention, and is intended to provide an overview for the understanding of the nature and character of the roller cap applicator devices. The accompanying drawings are included to provide a further understanding of various features and embodiments of the method and devices of the invention which, together with their description serve to explain the principles and operation of the invention.

What is claimed is:

1. A roller liquid compound applicator for applying a coating of a liquid compound to a target surface, wherein the applicator is configured to threadably attach to a liquid compound supply container having an externally threaded neck which defines and surrounds an external opening into the container, wherein the neck is configured to have a flat end as its distalmost surface and at least one of internal and external rims that deflect the surface of the flat end into respective internal and threaded external surfaces that form surfaces of the neck, wherein the roller liquid compound applicator comprises a U-shaped roller support frame comprising arms for support of a roller axle, a dispenser coupling cap and a drip guard attached to or integrated with the dispenser coupling cap, and a roller axle that is rotatably retained by arms of the roller support frame which provide an axis, and a liquid compound roller sleeve secured to or integrated with the roller axle and capable of rotating about the drip guard surface and the axis of the roller axle, wherein the roller support sleeve is positioned adjacent or contacting the drip guard;

wherein the dispenser coupling cap comprises an internal threaded cavity that is defined by a cylindrical threaded surface for attaching the liquid compound supply container, an opening at one end that is continuous with the opening in the externally threaded neck of the attached liquid supply container, and an opposite base end comprising a flat annular base, an annular conical wall projecting from the base and an opening in the base surrounded by the conical wall to form a liquid flow path from the liquid supply container through the threaded cavity to a liquid reservoir within the cap;

wherein the liquid reservoir is open to two or more flow ports that open into and are connected by a liquid compound distribution channel which is configured as a recessed channel in the drip guard upper surface such that the liquid compound can exit the flow ports into the liquid compound distribution channel and onto the roller sleeve, whereby the distribution channel and the drip guard act in concert to regulate the flow of the liquid compound and to evenly distribute the liquid compound over the liquid compound roller sleeve external surface for transfer onto the target surface; and wherein the conical wall projects from the base cap surface and is sized and configured to partially project into the opening of the neck of the attached liquid supply container and has an oblique surface, whereby the oblique surface bears and seals against the inner rim of the neck, and wherein the neck end may bear against an optional O-ring that is forced against the flat annular base of the roller liquid compound applicator between the conical wall and cylindrical threaded surface.

2. The roller liquid compound applicator of claim 1, wherein the roller support frame comprises a first L-shaped support frame arm attached to the dispenser coupling cap and a second L-shaped support frame arm attached to the dispenser coupling cap.

3. The roller liquid compound applicator of claim 2, wherein the liquid compound roller sleeve is disposed on a roller axle having a first end rotatably secured to the first support frame arm and a second end rotatably secured to the second support frame arm.

4. The roller liquid compound applicator of claim 1, wherein the drip guard comprises a concave surface that lies adjacent or touching the liquid compound roller sleeve and permitting rotation of the roller sleeve.

5. The roller liquid compound applicator of claim 1, wherein the dispenser coupling cap comprises a threaded cavity that is sized and configured for attachment to the liquid supply container.

6. The roller liquid compound applicator of claim 1, wherein the base end of the coupling cap comprises a flat annular base bounded by a conical wall an outward-facing bevel, wherein of the threaded neck of the liquid supply container engages the flat annular base via an O-ring and the beveled wall engages the inner rim of the threaded neck when the dispenser coupling cap is screwed onto the threaded neck of the liquid supply container and the rim contacts the beveled wall forming a liquid-tight searl.

7. The roller liquid compound applicator of claim 1, wherein the threaded cavity comprises, instead of a single annular conical wall, an annular groove having two concentric annular beveled walls, each having an oblique surface facing the other beveled wall, wherein the smaller diameter annular wall is an inner beveled wall and larger diameter annular wall is an outer beveled wall, wherein the walls are configured such that the beveled surfaces face toward each other and wherein the inner and outer rims of the neck of the liquid supply container respectively engage the inner beveled wall and the outer beveled wall when the dispenser coupling cap is screwed onto the threaded neck of the liquid supply container, thereby accommodating a circumference and wall thickness range of the neck end defined by the relative minimum and maximum diameters of the two annular beveled walls.

8. A roller liquid compound applicator for conveying a predetermined amount of a liquid compound from a liquid supply container to a target surface, wherein the liquid supply container comprises an inner surface capable of containing a liquid and a cylindrical externally threaded neck that opens into the container inner surface at one end and having a flat end as its distalmost surface and at least one of internal and external rims that deflect the surface of the flat end into respective internal and threaded external surfaces that form surfaces of the neck, whereby at least one of the internal or external rims threadably seals to the applicator at the other end, and wherein the roller liquid compound applicator comprises a dispenser coupling cap comprising an internal threaded cavity that is defined by a cylindrical threaded surface that threadably attaches to the liquid supply container and an internal flat annular base end of the threaded cavity that seals against the neck of the container when the dispenser coupling cap is screwed onto the threaded neck of the liquid supply container, wherein a liquid-tight seal is formed between the base end, which comprises an annular outwardly beveled wall projecting from the base end surface and configured so that the beveled surface of the wall mates with the inner rim of the threaded neck of the liquid supply container, wherein the inner rim is a surface deflection from the neck end of the liquid compound supply container into an internal surface of the container, wherein the neck end also may bear against an optional O-ring that is forced against the flat annular base end of the roller liquid compound applicator formed in the applicator between its conical wall and cylindrical threaded surface, and wherein the roller liquid compound applicator further comprises a U-shaped roller support frame;

a drip guard with a concave surface disposed on the dispenser coupling cap;

a liquid compound roller sleeve secured to the roller support frame, wherein the roller sleeve has a convex surface and the liquid compound roller sleeve is partially enclosed by the drip guard concave surface;

a liquid compound conveyance path that extends from the liquid supply container to the liquid compound roller sleeve, wherein the conveyance path comprises a liquid conduit that leads through the threaded cavity base end of the dispenser coupling cap from the liquid supply container and into a liquid reservoir;

the liquid reservoir that holds a predetermined quantity of the liquid compound, wherein the reservoir is disposed between the base end of the dispenser coupling cap and at least two liquid compound flow ports;

the liquid compound flow ports which extends from the liquid reservoir to within a liquid compound distribution channel recessed into the drip guard concave upper surface; and the liquid compound distribution channel which provides a liquid flow path between the liquid compound flow ports, whereby the liquid compound distribution channel aids to evenly distribute and minimize dripping of the liquid compound received from the liquid compound flow ports between the drip guard concave upper surface and across the convex external surface of the roller liquid compound applicator.

9. The roller liquid compound applicator of claim 8, wherein the roller support frame comprises a first and a second L-shaped support frame arm, both of which are attached to the dispenser coupling cap.

10. The roller liquid compound applicator of claim 9, wherein the liquid compound roller sleeve is disposed on a roller axle, which has a first end rotatably secured to the first L-shaped support frame arm and a second end rotatably secured to the second L-shaped support frame arm.

11. The roller liquid compound applicator of claim 8, wherein the threaded neck of the dispenser coupling cap is sized and configured to threadably attach to the liquid supply container.

12. The roller liquid compound applicator of claim 11, wherein the end of the coupling cap comprises a flat annular base bounded by a conical wall wherein the rim of the threaded neck of the liquid supply container engages the flat annular base via an O-ring and the conical wall engages the inner rim of the threaded neck when the dispenser coupling cap is screwed onto the threaded neck of the liquid supply container and the rim contacts the oblique surface of the beveled wall.

13. The roller liquid compound applicator of claim 11, wherein the threaded neck comprises, instead of a single annular conical wall, an annular groove having two concentric annular beveled walls, each having an oblique surface facing the oblique surface of the opposing beveled wall, wherein the smaller diameter annular wall is an inner beveled wall and larger diameter annular wall is an outer beveled wall, wherein the walls are configured such that the oblique surfaces face toward each other and wherein the inner and outer rims of the neck of the liquid supply container respectively engage the inner beveled wall and the outer beveled wall when the dispenser coupling cap is screwed onto the threaded neck of the liquid supply container, thereby accommodating a circumference and wall thickness range of the neck defined by the relative minimum and maximum diameters of the two annular beveled walls.

14. The roller liquid compound applicator of claim 8, wherein the drip guard is adjacent to or contacting the roller sleeve, the distance between the drip guard and the roller sleeve thereby functioning to regulate the liquid volume available to the roller sleeve and the drip guard, thus decreasing liquid drips from the applicator and excess liquid delivery to the roller sleeve and to the target surface.

* * * * *